US005471009A

United States Patent [19]

Oba et al.

[11] Patent Number: 5,471,009

[45] Date of Patent: Nov. 28, 1995

[54] SOUND CONSTITUTING APPARATUS

[75] Inventors: Haruo Oba; Junnichi Nagahara, both of Tokyo, Japan

[73] Assignee: Sony Corporation, Tokyo, Japan

[21] Appl. No.: 122,363

[22] Filed: Sep. 17, 1993

[30] Foreign Application Priority Data

Sep. 21, 1992 [JP] Japan ..... 4-274795

[51] Int. Cl.[6] ..... G10H 7/00

[52] U.S. Cl. ..... 84/645; 84/654; 84/616; 84/600; 381/51

[58] Field of Search ..... 84/600–603, 616, 84/645, 654; 381/51

[56] References Cited

U.S. PATENT DOCUMENTS

| | | | |
|---|---|---|---|
| 4,441,399 | 4/1984 | Wiggins et al. | 381/51 X |
| 4,731,847 | 3/1988 | Lybrook et al. | 381/51 |
| 5,235,124 | 8/1993 | Okamura et al. | 84/601 |

*Primary Examiner*—William M. Shoop, Jr.
*Assistant Examiner*—Jeffrey W. Donels
*Attorney, Agent, or Firm*—Jay H. Maioli

[57] ABSTRACT

A sound constituting apparatus translates a sensor output, as detected by an input detection unit, such as state changes, into electrical signals. A data extracting unit makes use of these electrical signals as an information concerning an external environment to extract the results of analyses of the information concerning the external environment as data. A sound source controlling unit outputs sound source controlling data, based on the data extracted by the data extracting unit, and translates the output signals into a modified sound by a sound producing device to eliminate time constraint. In producing the sound, at least one of physical parameters, namely the noise of the external environment, vibrations, light, temperature, humidity or atmospheric pressure, time parameters such as time, day and season and biological information parameters, such as brain waves, body temperature, pulsation, perspiration, number of breaths, is selected to detect the state or changes in the state in such external environment or living body for conversion into electrical signals. The apparatus then fetches the information concerning the external environment to translate it instantly into an output sound totally different from the original sound. In this manner, a sound totally different from the original sound is produced and outputted without employing complex theories.

11 Claims, 13 Drawing Sheets

FIG.11(a)
FIG.11(b)
FIG.11(c)
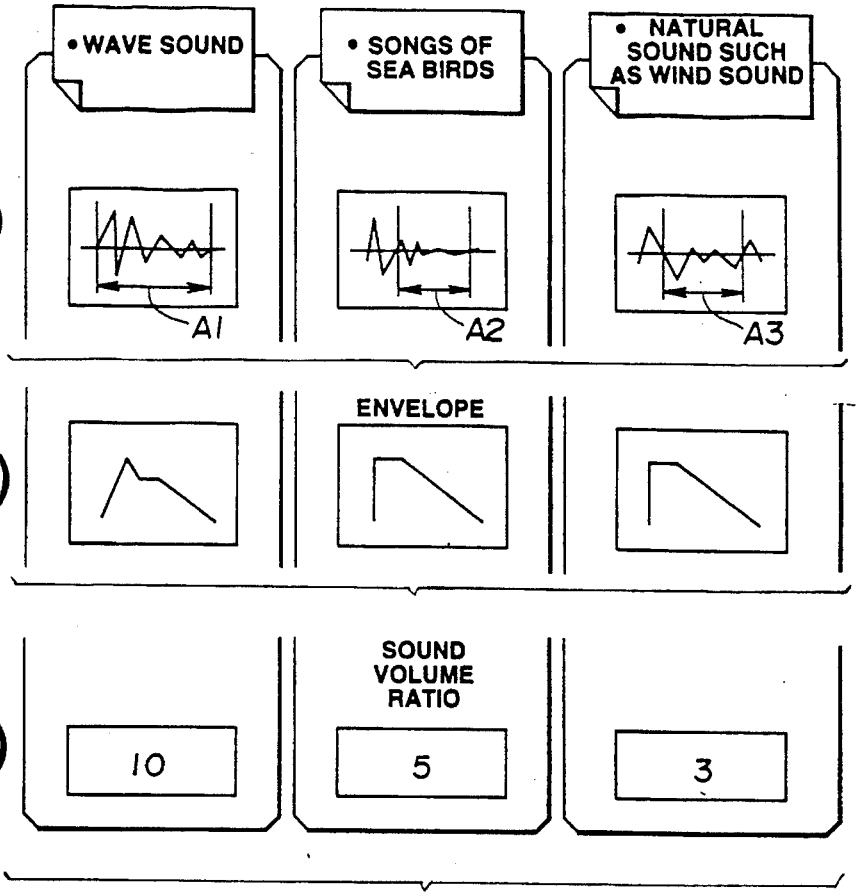
FIG.12
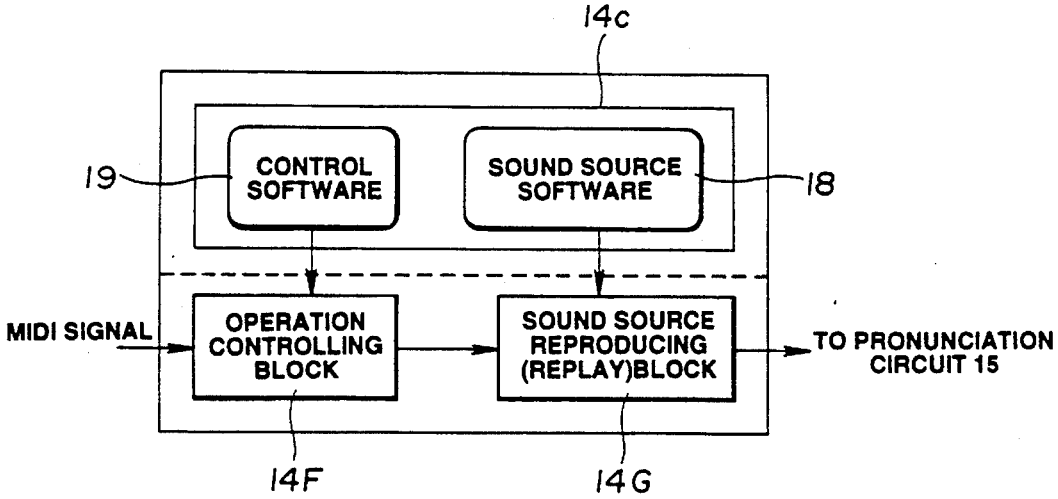

SOUND CONSTITUTING APPARATUS

BACKGROUND OF THE INVENTION

1. Field of the Invention

This invention relates to a sound constituting apparatus in which the information of phoneme elements constituting a sound is previously stored in storage means, the information of the phoneme elements is interacted with the information extracted from detection trigger signals of the external environment or changes thereof to produce a modified sound resulting from such interaction on the real-time basis without constraint as to the play time.

2. Description of the Related Art

Among customary sound reproducing apparatus, there are a record player, employing a record, an optical disc player, employing an optical disc, and a cassette tape recorder, employing a magnetic tape, depending on the type of the recording media employed. These sound reproducing apparatus are designed to reproduce information signals, that is sound data, as software data pre-recorded on the recording medium, for the user to listen to music or to confirm the contents of conversation recorded on the recording medium.

In general, the sound constituting apparatus is designed using both the hardware, as a circuit arrangement, and software, as the information signals recorded on the recording medium. Specifically, the sound constituting apparatus is frequently employed for music composition by exploiting e.g. a computer, audio equipment and a recording medium as the soft ware. Some sound reproducing apparatus have the function of translating the tone played by a user into a music note. Recently, a so-called computer music, which exploits the sound reproducing apparatus having such function, has become popular.

There are also occasions wherein the computer music is employed for causing a musical instrument to play automatically.

For such automatic play of the musical instrument, the sound reproducing apparatus supplies music instrument digital interface (MIDI) sequence data, pre-recorded in the apparatus for sound reproduction, to a sound source device for sound production. In effect, a system having the sound reproducing apparatus employed for playing the above-mentioned computer music is utilized for composing a music piece by supplying the above-mentioned MIDI sequential data to an audio equipment, such as a sampler, one of such sound source devices, for producing live performance by music instruments.

In general, when music is automatically played using the above-mentioned sound reproducing apparatus, the playing time is limited to a certain time interval, depending on the recorded contents, because of limitations imposed on the recording capacity of the recording medium employed for pre-recording the MIDI sequential data for sound reproduction. That is, the recordable time of the magnetic tape, for example, corresponds to the predetermined time, and the recorded data for such predetermined time is reproduced for such play with the result that data playback is made by the sound reproducing apparatus only during a fixed play time interval.

For prolongation of the playing time, the range of play and the number of times of repetition may be set for repeated program execution on the sound reproducing apparatus, using a program having a loop function.

On the other hand, the recent tendency in music is that not only the hardware aspect is changed, but also the music played thereby, that is the music software, is also changed. Such change in the music software is incurred to a greater extent by changes in human society. That is, the present-day human society is variegated in taste or liking, as exemplified by the nightless city or the increase in leisure time with corresponding changes in human life time. The present day preference is towards richness and quietness of mind rather than material richness. The liking for music is also changed towards actively expressing the listener's sense rather than passively listening to pre-recorded music.

In keeping up with changes in such social trends, more and more attention has now been directed to interaction of man with external environment, such as nature. Thus a demand has been raised towards an apparatus which has environmental sound in a wood or on a beach as a theme to release the hearer from daily routine by way of reflecting the individual taste or liking.

Meanwhile, with the conventional sound constituting apparatus, sound data pre-recorded on the recording medium are reproduced for constituting the sound field. Consequently, should data recorded on the recording medium be played only once without employing the continuous repeated playback mode as set by the program software, the play time is limited to a value fixed for each apparatus because of characteristics of the playing technique for reproducing data taken out from the recording medium as the sound or the capacity of the recording medium. Conversely, elongation of the play time means increasing sound data recorded on the recording medium employed for replaying the music. Consequently, the elongation of the play time leads to increase in the recording capacity in proportion to the replay time and to the necessity of providing plural recording media.

It is therefore impossible with the currently employed music replaying apparatus to effect replay over a prolonged time duration without repeated reproduction or without employing plural media. Besides, since the current sound reproducing apparatus makes use of pre-recorded sound data, it is not possible to change the playing state automatically and instantly responsive to the state of the listener or listening space.

On the other hand, the technical knowledge or skill for musical performance or composition as well as knowledge or skill concerning a complex computer technology is essential for activities in music performance or creation. Consequently, there are not many who are capable of being engaged in these activities in consideration of difficulties in acquiring such knowledge or skill. Those not capable of being engaged in these activities cannot but listen to the reproduced music only passively. On the other hand, with the conventional sound reproducing apparatus, it is not possible for a listener to participate actively in the play state or listening space as when he is listening to a live concert in a hall.

OBJECT AND SUMMARY OF THE INVENTION

It is a principal object of the present invention to provide a sound producing apparatus whereby effective acoustic effects may be achieved by real-time production of the sound suited to the listener's request responsive to the state of external environment or changes in such state without constraint by the play time.

The sound constituting apparatus translates changes in an external environment into electrical signals via a detection unit. A data extraction unit extracts the results of analyses of the electrical signals as data which is supplied to sound source controlling means. The sound source controlling means outputs sound source control data based on the extracted data. Sound signals corresponding to the control data are outputted by sound source means and translated so as to be outputted at sound producing means to eliminate time constraint. In producing the sound, at least one of various physical parameters, namely the noise of the external environment, vibrations, light, temperature, humidity or atmospheric pressure, time parameters such as time, day and season and biological information parameters, such as brain waves, body temperature, pulsation, perspiration, number of breaths, is selected to detect the state or changes in the state in such external environment or living body for conversion into electrical signals. The apparatus then fetches the information concerning the external environment to translate it instantly into an output sound totally different from the original sound. In this manner, a sound totally different from the original sound is produced and outputted without employing complex theories. Various sound elements may be edited and set for conversion into the sound different from the original sound. Above all, the noise in the environment may be instantly changed depending on the surrounding situation to elevate the interaction with the external environment and interdependency with the environment. By interaction with the input information extracted from the listener or the listening environment, it becomes possible to realize sound production rich in fortuity, unexpectedness and interactivity, as well as to eliminate time dependency, such as dependency on replay time, in distinction from the acoustic equipment for reproducing a recording medium.

The data extracting unit extracts the sound pitch from the electrical signals converted by the input means and generates the trigger information for sound production from data such as change in volume of a picture extracted from the picked up picture. The data required by the sound constituting apparatus is supplied independently of the play time to reduce the storage data volume to a minimum. The sound source controlling unit translates the supplied trigger information into MIDI standard data conforming to the sound or acoustic effects to elevate the degree of freedom of the produced sound. The sound source means outputs the phoneme signals responsive to pitch data of the MIDI information from the sound source controlling unit to improve the quality of output sound.

Thus it becomes possible for the sound constituting apparatus to formulate the imaginary reality-simulating sound or music in conformity to the program pre-stored in the apparatus. Besides, the listener is able to influence or participate in the performance to some extent.

With the sound constituting apparatus, a picture pick-up device is used as the input unit. The data extracting unit extracts the change volume in the pickup picture as data, while the sound source controlling means translates data from the data extracting unit into the MIDI information. The sound source unit outputs phoneme signals responsive to pitch data of the MIDI information from the sound source controlling unit to facilitate data control. The sound source controlling unit translates the data from the data extracting unit into the acoustic effect control information to facilitate sound effect control as well as to improve the sound quality. The sound source unit causes the sound source signal generating means to generate sound signals conforming to the MIDI information supplied from the sound source controlling means to enable the sound closer to the actual sound to be heard by the listener even if the sound is the imaginary reality-simulating sound. Such acoustic effects improve psychological effects on the listener.

By employing a card having an enclosed software work and the information concerning the apparatus, the sound creation may be improved in latitude.

Other objects and advantages of the present invention will become apparent from the description of the embodiments and the claims.

BRIEF DESCRIPTION OF THE DRAWINGS

FIGS. 11(*a*), (*b*) and (*c*) are diagrammatic views for illustrating typical setting for a loop, envelope and the sound volume ratio, respectively, as elements of the sound for settings natural sounds, such as wave sound, cry of sea fowls or wind so as to simulate the actual sound more faithfully.

FIG. 12 is a block circuit diagram for illustrating the constitution of a sampler in the sound constituting apparatus according to the present invention.

DETAILED DESCRIPTION OF PREFERRED EMBODIMENTS

Figure 1:
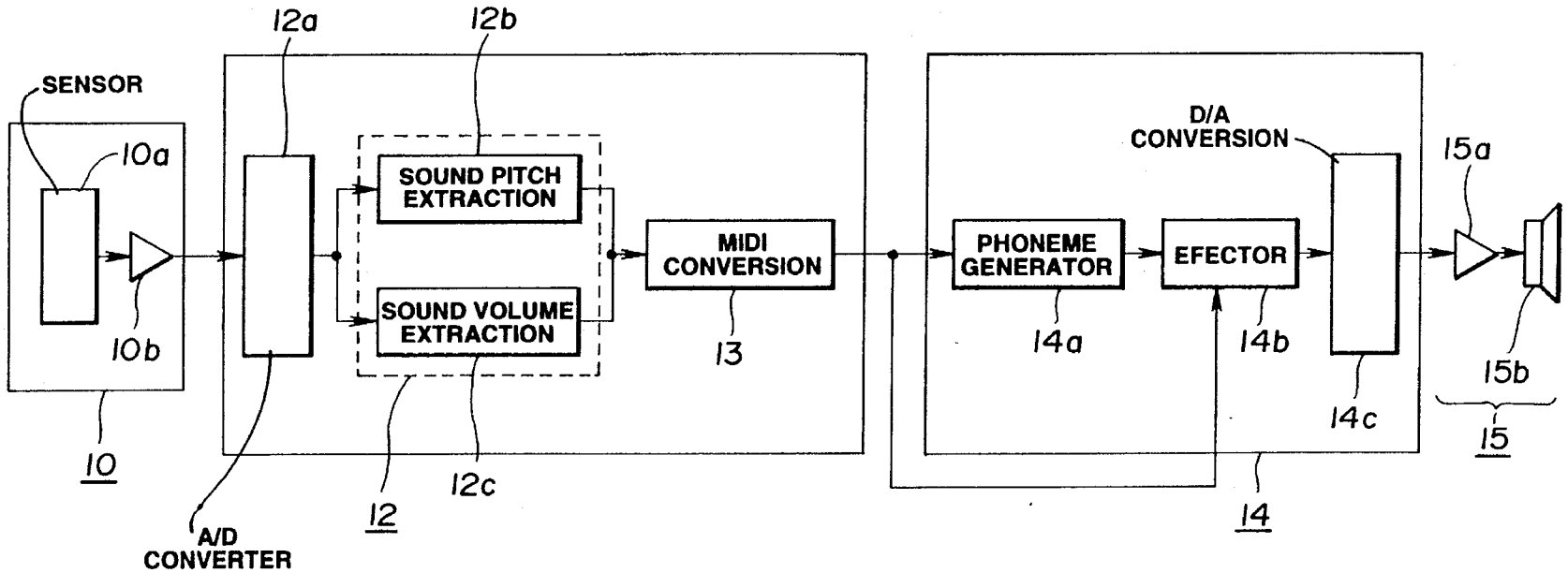
FIG. 1 is a block circuit diagram showing the basic construction of a sound producing apparatus according to the present invention.

Referring to the drawings, a sound constituting apparatus according to the present invention is explained in detail.

It is noted that, by definition, music is art by sound, or art which resides in performance with an instrument or human voice of a tune assembled in a variety of styles based on the rhythm, passage, tone color or chords, a combination of intensities, pitches or tone colors of the sound as the source to instigate an aesthetic feeling. Meanwhile, the sound which is produced by the sound constituting apparatus of the present invention, such as simulated actual sound or reproduced natural sound, and which is handled as general software music items, is also treated as music. The basic block arrangement of the sound constituting apparatus, capable of processing the sound, is hereinafter explained.

The sound constituting apparatus according to the present invention has a basic circuit arrangement shown in FIG. 1. That is, the sound constituting apparatus includes an input signal translating circuit section 10, as input means for inputting changes in external environment, translated into signals, a data extracting circuit 12 for analyzing output signals from the input means for extracting data, a MIDI signal translating circuit section 13 as sound source controlling means for outputting sound source controlling data based on sound source data extracted by the data extracting means, a sound source generating circuit section 14 as sound source means for outputting sound signals conforming to the control data from the sound source control means, and a sound producing circuit section 15 as sound producing means for translating output signals from the sound source generating circuit section 14 for producing the sound.

Meanwhile, the data extraction circuit section 12 and the MIDI signal translating section 13 may be considered as an integral data analysis circuit section 11.

Referring to these circuit sections in detail, the input signal translating circuit section 10 shown in FIG. 1 includes a sensor 10*a* for fetching changes in the external environment and translating the changes in the external environment into electrical signals, and an amplifier 10*b* for amplifying an output signal of sensor 10*a*. The sensor 10*a* is adapted for associating various sensors as later described with the sound constituting apparatus of the present invention.

The information concerning the external environment, thus fetched by the circuit section 10, is translated into digital signals, which are supplied to the data extracting section 12. The data extracting section 12 includes an A/D converter 12*a* for converting analog signal levels outputted via amplifier 10*b* into digital signals, a pitch extracting circuit section 12*b* for extracting the sound pitch from electrical signals and a sound volume extracting circuit section 12*c* for extracting the sound volume information from the electrical signals. The sound volume information is obtained as a mean value of the peak values of the supplied sound samples. The pitch extracting circuit section 12*b* supplies the extracted pitch information to a MIDI signal translating circuit section 13. It is possible for the sound volume extracting circuit section 12*c* to translate the extracted sound volume information into MIDI signals for controlling an amplified output of an amplifier 15*a* of the sound-producing circuit section 15 as later explained.

The MIDI signal translating circuit section 13 translates the sound information supplied thereto into MIDI standard signals via an equipment of a so-called musical instrument digital interface (MIDI) which is an international standard for communication of supplied sound information in digital signals. The aforementioned MIDI standard provides a variety of communication systems from hard format to soft format for digital data. In the digital data according to MIDI standard, the sound information is represented by a status byte and a data byte.

The status byte designates various statuses, such as note off or note on, by an MSB of "1" followed by three following bits, while defining an MIDI channel by the lower four bits. The data byte designates the data region by an MSB of "0", the remaining seven bits being a data region. The MIDI signal translating circuit section 13 outputs the digital signals, translated in this manner to conform to the designated standard, to the sound source generating circuit section 14 over e.g. an MIDI cable.

The sound source generating circuit section 14 is constituted by a phoneme generator 14*a*, an effector 14*b* and a D/A converter 14*c*. The phoneme generator 14*a* associates the phonemes of the wave sound, cry of black-tailed gulls or the cry of groups of long-bills with the digital data of the MIDI signals supplied thereto. The effector 14b processes the signals supplied thereto with acoustic effects including vibrato, modulation, reverberation etc. The signals which have undergone a sequence of these processing operations are supplied to a D/A converter 14*c*.

Meanwhile, the above constitution shows a constitution in which the effector is modified by digital processing. However, the effector 14*b* may also be provided downstream of the D/A converter 14*c*.

The D/A converter 14*c* converts the digital signals supplied thereto into analog signals which are transmitted to the sound producing section 15.

The sound producing section 15 is made up of an amplifier 15*a* and a speaker 15*b*. The amplifier 15*a* amplifies signals based on the digital data extracted from the above-mentioned sound volume extracting circuit 12*b*. The signals thus amplified are translated via a speaker 15*b* into sound signals.

By selecting and associating data of the MIDI standard and the phonemes by a software technique for producing the sound, using the input information corresponding to changes in external environment, it becomes possible to reproduce the sound with high degree of freedom and high quality without temporal constraint in reproduction, in distinction from the sound reproducing apparatus, for providing an acoustic equipment based on a totally new concept.

A concrete first embodiment in the sound constituting apparatus according to the present invention is explained with reference to a circuit arrangement shown in FIGS. 2 and 3 and to a manner of software formulation shown in FIGS. 4 to 12.

The parts or components common to those of the above-mentioned basic circuit construction shown in FIG. 1 are denoted by the same reference numerals.

Figure 2:
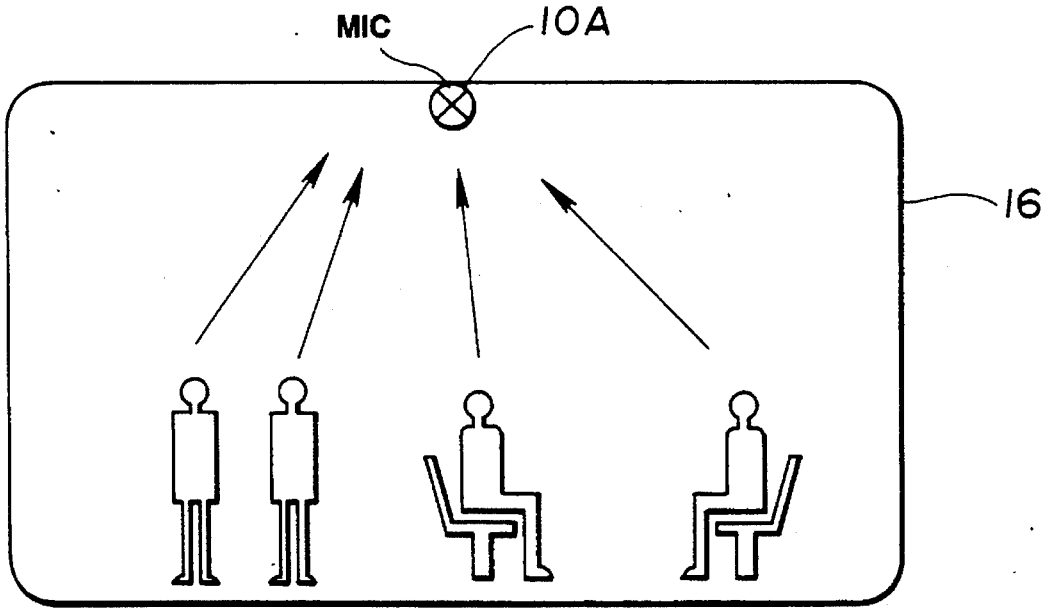
FIG. 2 is a schematic view showing the state of mounting of a microphone as a sensor of the sound constituting apparatus shown in FIG. 1 according to a first embodiment.

The present embodiment is explained with reference to a block diagram of FIG. 3 in which the sound of waves or the cry of fowl associated with the trigger produced in a space, such as a conference room 16 shown in FIG. 2 is produced and the conversation of those in the room 16 is sampled by a microphone 10A and the manner of sound production by the sound producing apparatus is changed in accordance with the sampled sound or the noise environment.

Figure 3:
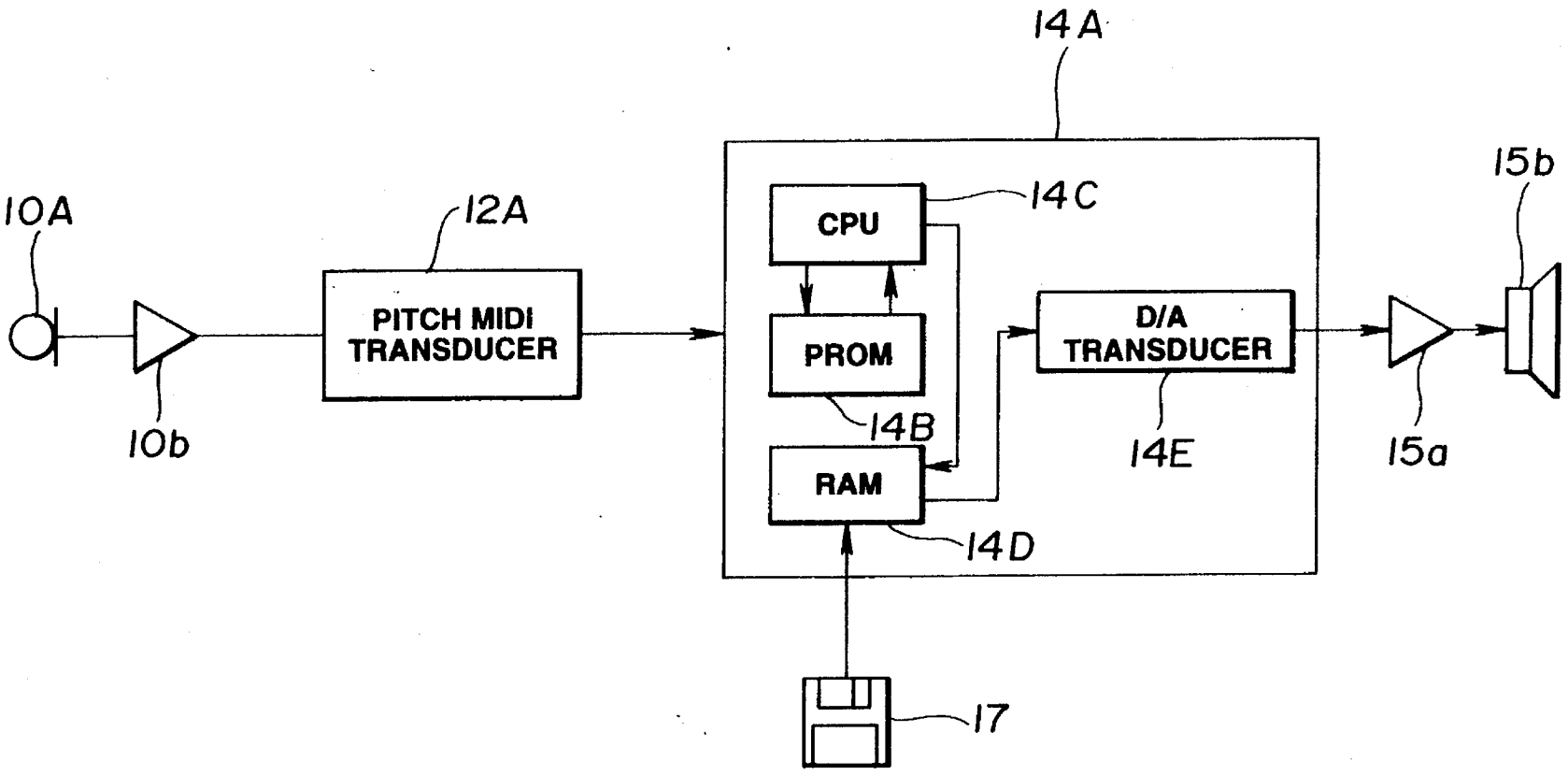
FIG. 3 is a block circuit diagram showing the first embodiment of the sound constituting apparatus of the present invention.

With the sound producing apparatus of the present invention, the sensor 10*a* includes a microphone 10A as a sensor of input means adapted for fetching the external environment into the sound constituting apparatus, as shown in FIG. 3. The microphone 10A fetches the sound of the external environment. The noise of the external sound is collected and entered using the microphone 10A which is the acousto-electric transducer as such input means. These electrical signals are employed as a switching trigger in sound production in the sound constituting apparatus. The microphone 10A may for example be a conventional capacitor or dynamic type device.

The sound of the external environment, converted into electrical signals, is amplified via amplifier 10*b* to a line level and transmitted to a pitch to MIDI transducer 12A of the data analysis section 11 which is adapted for extracting the sound pitch from the electrical signals for translation into MIDI standard digital data.

The pitch to MIDI transducer 12A translates the analog signals supplied thereto into digital signals by an A/D converter, not shown, corresponding to A/D converter 12*a* shown in FIG. 1. These digital signals are processed by the pitch to MIDI transducer 12A corresponding to the pitch extracting circuit 12*a* shown in FIG. 1 so as to be converted into numerical figure data as the acoustic information concerning the fundamental frequency, sound pressure level or temporal changes of the sound. The pitch to MIDI transducer 12A also has the function corresponding to that of the sound volume extracting circuit 12*b* because the transducer 12A also extracts the information concerning the sound volume as the mean value of the sound from the sound pressure level. The pitch to MIDI transducer 12A also translates the above-mentioned information into signals of the MIDI standard to supply the MIDI signals to sampler 14A which is the sound source producing circuit section 14.

Analyses and translation of a series of the acoustic information is performed by an enclosed CPU, not shown.

In effect, the sound information is translated into MIDI standard information in such a manner that the fundamental frequency of the sound, sound pressure level, temporal changes and the information concerning the changes following the sound production, are translated into note number, velocity level, note on or off and after-touch, respectively. The MIDI standard digital data, as the acoustic information, is supplied as the sound produced by the sound source generating circuit section 14 controlled by the MIDI standard or as the play information. The sound source generating circuit section 14 is responsible for the association of the phonemes generated by the acoustic information.

According to the present invention, the association of the sound for the information is performed by a CPU 14C which encloses MIDI signals supplied via an MIDI interface, not shown, and the software recorded in PROM 14B, with e.g. a keyboard, whereby phonemes stored in advance are outputted via RAM 14D as the corresponding playback signals. The software technic showing the association of the information of the sound is explained later in detail.

As an acoustic equipment corresponding to the sound source generating section 14, a sampler 14A, for example, is employed. The sample 14A is inherently an acoustic equipment developed for musical instrument. Thus the attributes associated with the scales are determined by a method comparable to that used in a synthesizer. The synthesizer creates the desired tone color by dividing the sound into plural elements.

The sound and the sampler are explained briefly. The sampler samples the sound to store it in the form of digital data converted from the sound. For reproduction, the stored digital data are reproduced by setting the sound pitch parameter at a desired value.

With the above described sampler, it is possible to store the cry of animals or the sound of the live sound for a musical instrument, converted into digital data, in the sampler and the sound pitch is changed to the stored sound with a freely selected melody by playing on keys of the keyboard. Thus, in distinction from the synthesizer which synthesizes the tone color from the outset, the sampler synthesizes the sound with the tone color which is found in existing sound in nature outside the musical instrument.

Since the sampled digital audio data is difficult to process directly, the digital audio data has to be processed slightly. This processing operation is the so-called editing operation. This editing operation is carried out by a so-called software, or so-called sample editing system. The editing software includes a variety of functions, such as a looping function, equalizing function, filter function, pitch shifting function, time compressing or expanding function or amplitude modifying function.

The looping function is employed for repeatedly and efficiently reproducing a portion of the sampled waveform to express the sustained sound. The equalizing function is employed for modifying a particular frequency component of the sound for rewriting the waveform. The filtering function is employed for selectively taking out the frequency of the sound.

Figure 4:
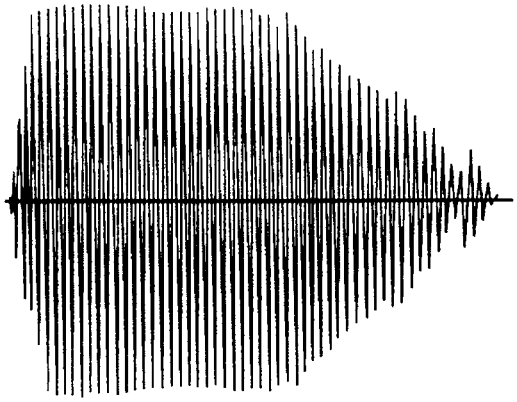
FIG. 4 is a waveform diagram for illustrating the pitch shift function of changing the sound pitch without changing the fundamental frequency (that is a sound interval) of sampled sound as sound elements.
Figure 5:
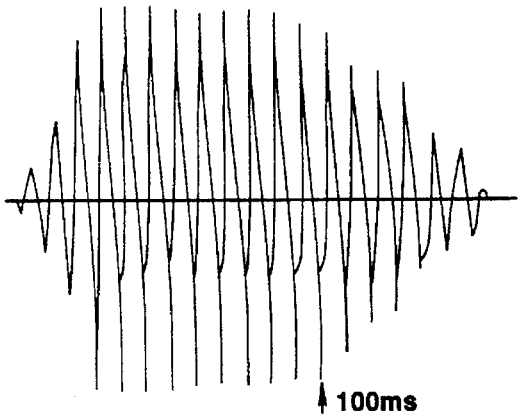
FIG. 5 is a waveform diagram for illustrating the time compressing function of reducing the playback speed without changing the sound pitch of the sampled sound as sound elements.

In general, the higher the playback speed in e.g. the tape reproduction, the higher is the interval of the sound. Conversely, the lower the reproducing speed, the lower becomes the interval. On the other hand, it is possible with the sampler to change only the sound pitch, with the reproducing speed of the sampled sound remaining unchanged. Such function of changing only the sound pitch is called the pitch shifting function (FIG. 4).

Figure 6:
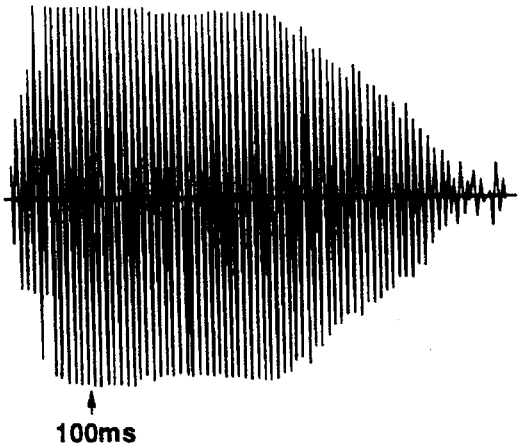
FIG. 6 is a waveform diagram for illustrating the time expanding function of elongating the playback speed without changing the sound pitch of the sampled sound as sound elements.

The time compressing and expanding function is the function opposite to the pitch shifting function, that is, a function of changing only the playback speed, with the sound pitch unchanged, for diminishing the sound reproducing speed (FIG. 5) and for elongating the sound reproducing speed (FIG. 6). The reduction and elongation of the sound reproducing speed means the attenuation of the playback sound within a shorter time interval on the order of 100 ms and the attenuation of the playback sound within a longer time interval on the order of 400 ms.

Figure 7:
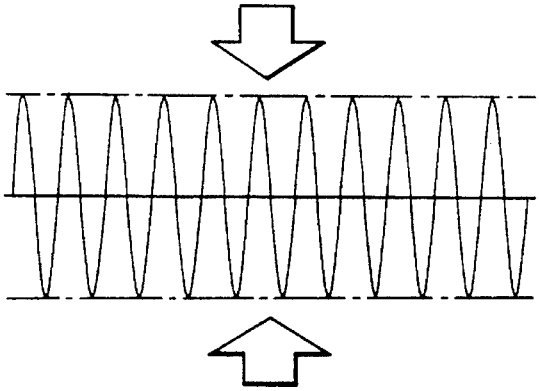
FIG. 7 is a waveform diagram for illustrating the function of modifying the amplitude for rewriting the waveform by calculation for adjusting the sound magnitude relative to the sampled sound as sound elements.
Figure 8:
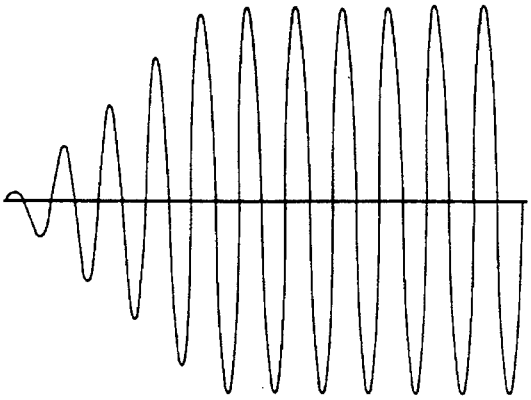
FIG. 8 is a waveform diagram for illustrating the enveloping function of setting the sound rising relative to the sampled sound as sound elements.
Figure 9:
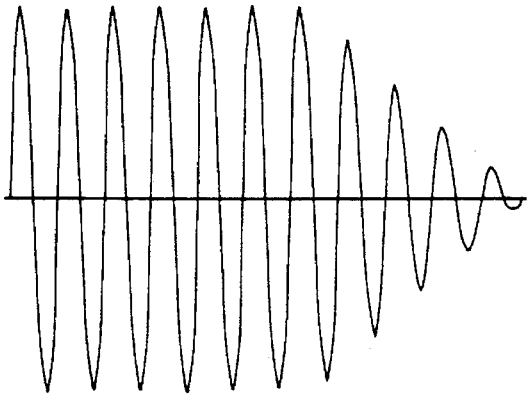
FIG. 9 is a waveform diagram for illustrating the enveloping function of setting the sound attenuation relative to the sampled sound as sound elements.

The amplitude changing function is the function of rewriting the waveform by calculation for matching the sound magnitude (FIG. 7). By freely modifying various portions of the waveform by way of developing this function, the so-called envelope setting, such as sound rise or decay may be set, as shown in FIGS. 8 and 9.

The sampler employed as the sound source pre-records the waveform of the sound prescribing the tone color in RAM or ROM as digital data. By setting the envelope in the above-described manner, it becomes possible to set in which manner the digital data is reproduced as the playback sound of the recorded sound source.

The software operations then proceed to deciding the sound volume of each sound source in association with the note number of the MIDI standard for deciding the pitch and the volume of each sound source. In other words, a variety of attributes, that is which of the sound sources (or sound waveforms) is to be associated with a tone of a given frequency and how and with which sound volume the sound is to be changed (or changes in envelope), are now defined.

For defining the playback sound, the sampler 14A changes the attributes of the envelope and the waveform of the sound as the sound pitch, sound volume and the tone color, in accordance with the attributes, for supplying the compositely controlled playback signals to D/A converter 14E. The D/A converter 14E translates the playback signals into analog signals which are outputted to sound source producing circuit section 15. It is possible with the sampler to store the sound sources and the attributes of the sound on an external storage medium, such as a floppy disc 17. If a variety of digital data stored on the recording medium are read into a sampler memory, the sampler may be employed not only for the scene of the sea but also for other sound sources, so that the sounds of various environments may be reproduced conveniently.

The playback signals translated by the D/A converter 14E into analog signals are amplified by an amplifier 15*a* so as to be reproduced by a speaker 15b installed in conference room 16. In this manner, the present sound constituting apparatus reproduces the natural sound with the environmental sound picked up by microphone 10A as a trigger signal. It is possible for the amplifier 15*a* to control the amplitude, that is sound volume, of the playback signals depending on signals of the MIDI standard or to feed back the sound produced by the sound constituting apparatus to control the acoustic state perpetually.

Although the method of converting the environmental sound used as a trigger as described above into MIDI standard signals by pitch-MIDI converter is employed in the above-described embodiment, the trigger converting method is not limited to that used in the above-described embodiment. In the present embodiment, since the data analysis section 11 is separated from the sound source generating circuit section 14, it is employed as a means for signal transmission. The MIDI standard is used after all as simple expedient.

The practical software is explained by referring to the sea scene described above. The software program includes the results of data analyses of the input data entered as trigger and phonemes as constituent elements of the music to be constituted and the information as to how the phonemes are to be associated with the numerical figures corresponding to the results of analyses.

In proceeding to the formulation of a software work, the constitution of the sound in a given environment is analyzed from the viewpoint of music and sound scape designing. This concept of the sound scape designing is introduced in "Tuning World" written by Mary Schaffer, published by HEIBONSHA Publishing Company. The constituent sound in the sound scape designing is roughly classified into the fundamental sound and ornaments.

The fundamental sound is defined as the fundamental sound in forming an image of a sound in an environment. The ornaments are defined as the sound which characterizes the sound formed by the fundamental sound.

In formulating the software work for the sound producing apparatus, it is necessary to distinguish the two sounds among the sounds collected and reproduced. One of the methods which may be employed in such distinguishment is to search into the frequency with which the sound is produced at respective frequency points.

With the first embodiment, the sound in a conference room, as collected by microphone 10A, may be translated into signals according to MIDI standard by being passed through the pitch-MIDI transducer 12A, as mentioned above. The pitch-MIDI transducer 12A has a MIDI monitor through which the signals according to the MIDI standard are passed to check for the frequency of occurrence with which the sound of a given frequency is present in the input sound. FIG. 10(A) shows a graph indicating the frequency of occurrence relative to the signal frequency.

FIG. 10(A) shows that the occurrence frequency of input sound sampled in a conference room with respect to the signal frequency is highest in the vicinity of 100 Hz followed by that in the vicinity of 10 kHz. It may be seen from the above definition that the sound in the vicinity of 100 kHz of the input sound shown in FIG. 10(A) represents the sound domain as the fundamental sound, with the sound in the vicinity of 10 kHz being the sound domain for the ornaments.

The results of frequency analyses of the sound collected in the conference room have revealed that, with the sound having the fundamental sound in the above defined frequency, the fundamental sound is associated with the sound of conversation shown in FIG. 10(B), while the ornaments are associated with the door opening/closing sound, air conditioner noise and human footstep sound.

First, the phonemes producing the corresponding sound is allocated as a sound source. If the allocated phoneme is reproduced, the interaction between the input sound and the playback sound is incurred to enable a software work based on the sound scape viewpoint to be prepared using the input sound as the trigger. The sound source equipment of the MIDI standard, employed in the above-described first embodiment, reproduces the sound source associated as a principle with the note numbers forwarded in accordance with the MIDI standard.

It is noted that 128 note numbers of from 0 to 127 are allocated to scales $C_{-2}$ to $C_8$, with the central "C" in a 88-key piano, that is $C_3$, as the note number 60.

Figure 10:
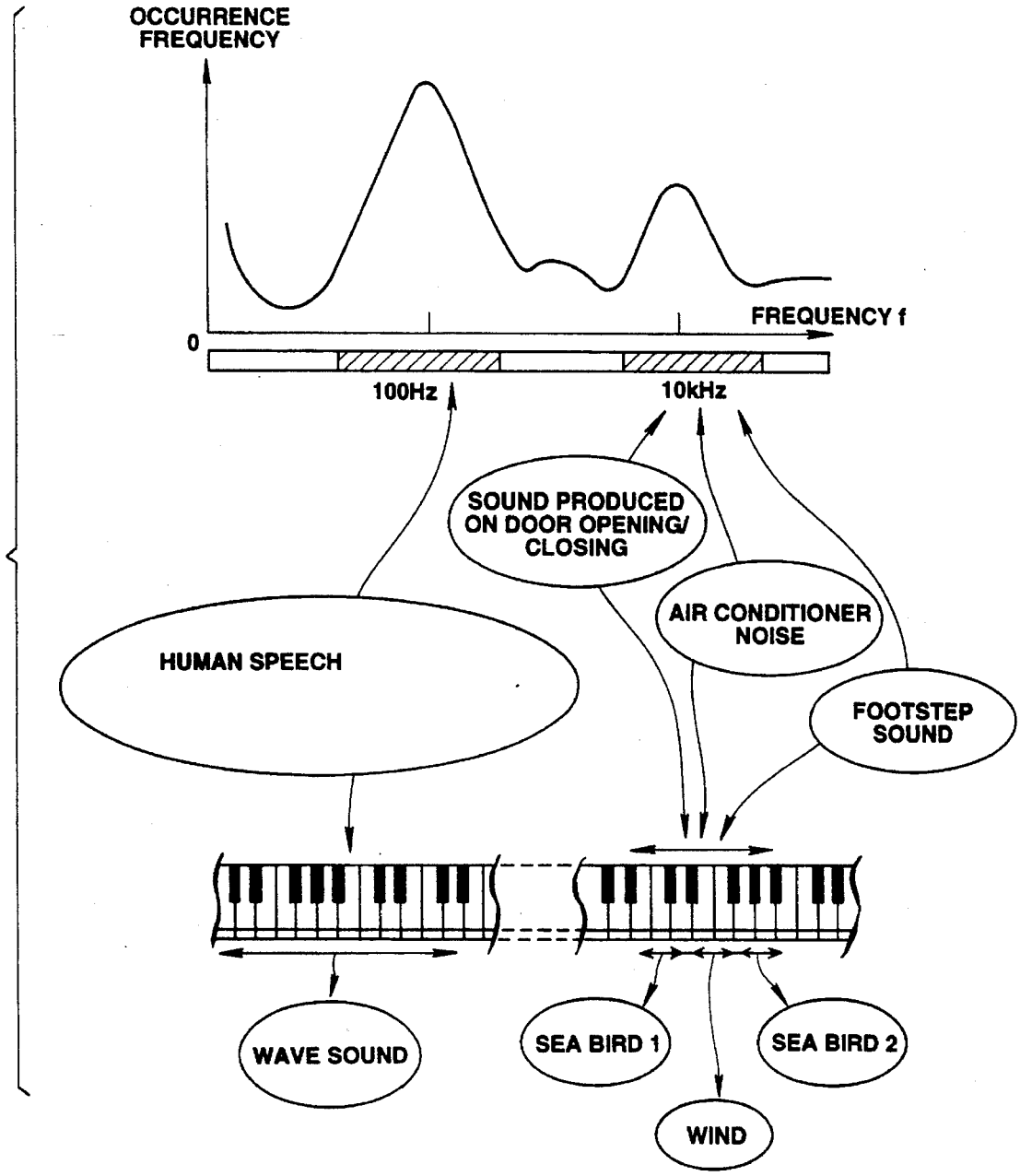
FIG. 10 is a diagram for illustrating the relation between sound data analyses and the software.

As shown in FIG. 10, the note numbers Nos. 30 to 40 are allocated to the fundamental sound for association with the wave sound, as shown in FIG. 10(D).

Also, as shown in FIG. 10, the note numbers Nos. 90 to 100 are allocated to the ornaments for association with the natural sound, such as wind hissing sound or cry of sea fowl 1, 2 other than the wave sound.

As a matter of fact, the wave sound having various periods is expressed by setting a variable pitch. For expressing the cry of sea fowl such as cry of black-tailed gull, the pitch and the phonemes to be set are rendered variable by software technique to prevent an unnatural sound due to a constant pitch from being generated so that the cry of the sea fowl is produced in plural sound pitch levels.

The phoneme allocation shown in FIG. 10(C) is performed by software technique to provide an overlap of various sound domains. By such sound allocation, the input sounds may be enunciated substantially uniformly if the input sound pitch is high or low.

If the replay of the sound having the above relation is made by changing the attributes of the sound, a certain amplitude is afforded to the expression of the replay sound. There are a variety of parameters concerning expressions of sound sources. Typical of these parameters are a loop which repeatedly reproduces a certain range of the waveform data, an envelope indicating temporal changes of the sound source, setting of sound volume of respective sound sources, setting of sound volume changes of the respective sound sources, filter setting of effecting changes in sound clarity by the setting of the cut-off frequency, sound image positioning, velocity indicating the sound intensity, selection of sound sources which should be enunciated simultaneously, etc.

FIGS. 11(*a*)–11(*c*) show examples of setting a parameter for three phonemes shown in FIG. 10. As may be seen from the corresponding waveform, the feeling of the wave sound is produced by reducing the gradient of the sound rise (attack) which is changed by the phoneme intensity. The feeling of the cry of sea fowl is produced by setting an environment in which cry of the sea fowl gives the impression of being produced at a far or a near-by place.

FIG. 11(*a*) shows waveforms of respective phonemes of the natural sound, such as the wave sound, cry of sea fowl or the wind hissing sound. In setting a loop, the wave sound reproduces a region A1 which is the entire waveform of the fundamental frequency. The loop period for the natural sound such as the cry of sea fowl and the wind hissing sound is the processing of repeating the regions A2 and A3.

FIG. 11(*b*) shows envelopes corresponding to the envelopes of amplitude waveforms of a sound. For example, the point of releasing a key or the point of changing of the interval of an input signal may be expressed as a sound release point. By elongating the release from the release point of the sound in formulating a software work, the sound produced by the sound constituting apparatus is set so as to be continued for some time even if a sound is produced momentarily and interrupted immediately. The two waveforms other than that for the wave sound are set so as to be substantially similar to each other. The sound features or continuation may be rendered smooth by finely setting the envelope in this manner.

The numerical figures indicated in FIG. 11(*c*) represent the sound magnitude corresponding to the prescribed sound level in terms of the sound volume ratio. The sound volume ratio of the cry of the sea fowl is set to 5, while that of the natural sound, such as the wind hissing sound, is set to 3. By setting the overall sound volume ratio, it becomes possible to realize the space feeling in the reproduced sound. Although a fairly acceptable expression may be achieved with a single sound source because the elements of various sounds employed for music formulation are present, it becomes possible to achieve more finely textured sound expression by setting the parameters for constituting the playback sound and using them in combination.

The software work encompasses not only the music software 18 for controlling the sound constitution, but also controlling software 19 shown in FIG. 12 in a PROM 14C of sampler 14A shown in FIG. 3. By such control software 19, playback signals are outputted to the sound producing circuit section 15 from a block 14F controlling the sampler 14A.

By separating the sampler hardware controlling software and the music software for setting the phonemes from each other, the sound produced may be endowed with increased latitude in expression. Above all, since the music software may be supplied from outside via a recording medium, the reproduced sound may be freely and easily set without the necessity of changing the hardware constitution.

Figure 13:
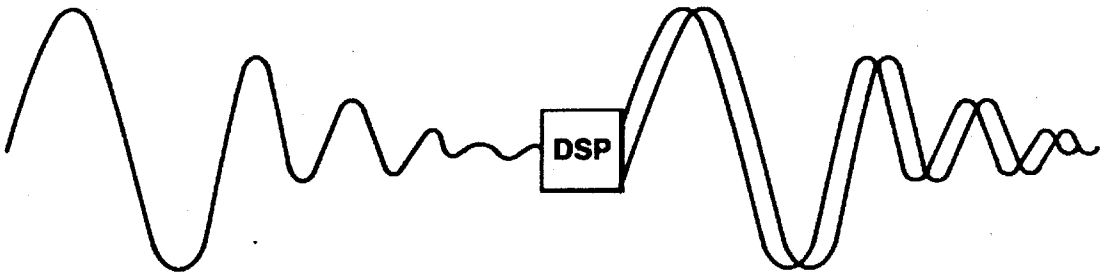
FIG. 13(A) is a schematic view for illustrating the method for outputting the sound by sound translation by conventional DSP.
FIG. 13(B) is a schematic view for illustrating the method for outputting the sound by sound translation by the sound constituting apparatus according to the present invention.
Figure 13:
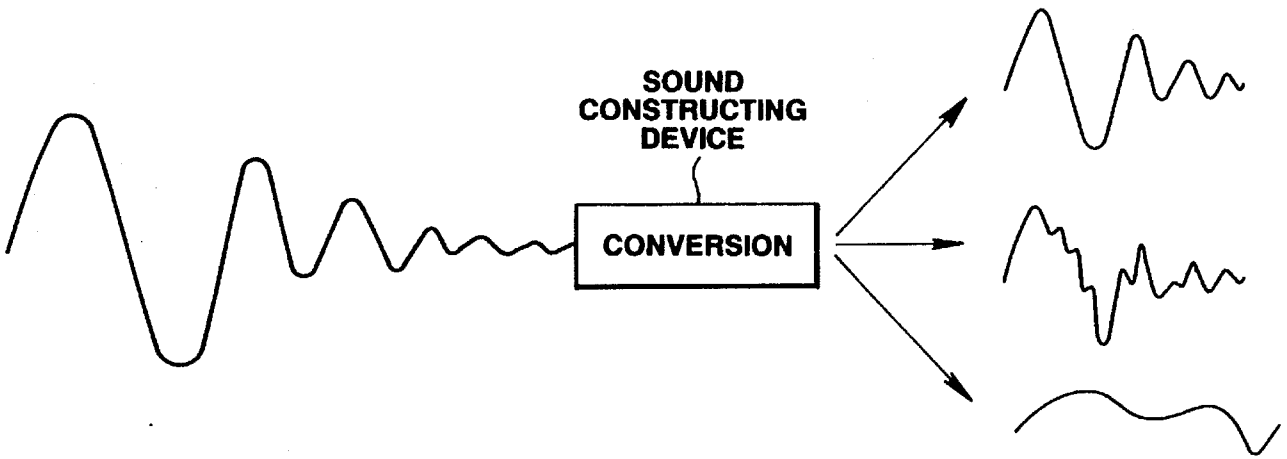

With the above-described constitution of the sound constituting apparatus, an output of the apparatus may be rendered totally different from the trigger sound after transformation into the wind hissing sound. With the conventional digital signal processor, although the original source and may be processed with echo processing or pitch change for waveform transformation shown in FIG. 13(A), it is extremely difficult or even impossible to perform a variety of signal processing operations as is done with the present sound constituting apparatus to output the musical sound totally different from the input signals as shown in FIG. 13(B).

It is possible with the sound constituting apparatus according to the present invention to translate the original sound into the sound totally different from the original sound by editing and setting various elements of each sound, using the phonemes as trigger sound, without the necessity of performing signal processing exploiting the above-mentioned complicated theory. Above all, the noise in the environment may be instantly transformed responsive to the prevailing situation.

Besides, the present sound constituting apparatus renders it possible to provide sound reproduction rich in fortuity, unexpectedness and interactivity by interaction between the apparatus and the listener and the listening environment.

It is also possible to eliminate time dependency of the reproducing time etc. The data required by the sound constituting apparatus with respect to the sound constitution or music may be rendered time independent by associating the input information from the external environment with the trigger data for reducing the data enclosed in the apparatus to a minimum.

It is possible with the present sound constituting apparatus to formulate the music or the imaginary reality-simulating sound In accordance with the program pre-stored in the apparatus without the necessity of employing a complex digital system. Besides, the user may be allowed to participate to some extent in music performance.

As for the program software employed in the sound constituting apparatus, a new program software which is not time dependent may be furnished to the market on the basis of limited data as mentioned above.

Although the sole sound producing apparatus suffices, as described above, it may be set for controlling a similar system via e.g. a MIDI output terminal for producing a variation of a larger number of results of performance.

Figure 14:
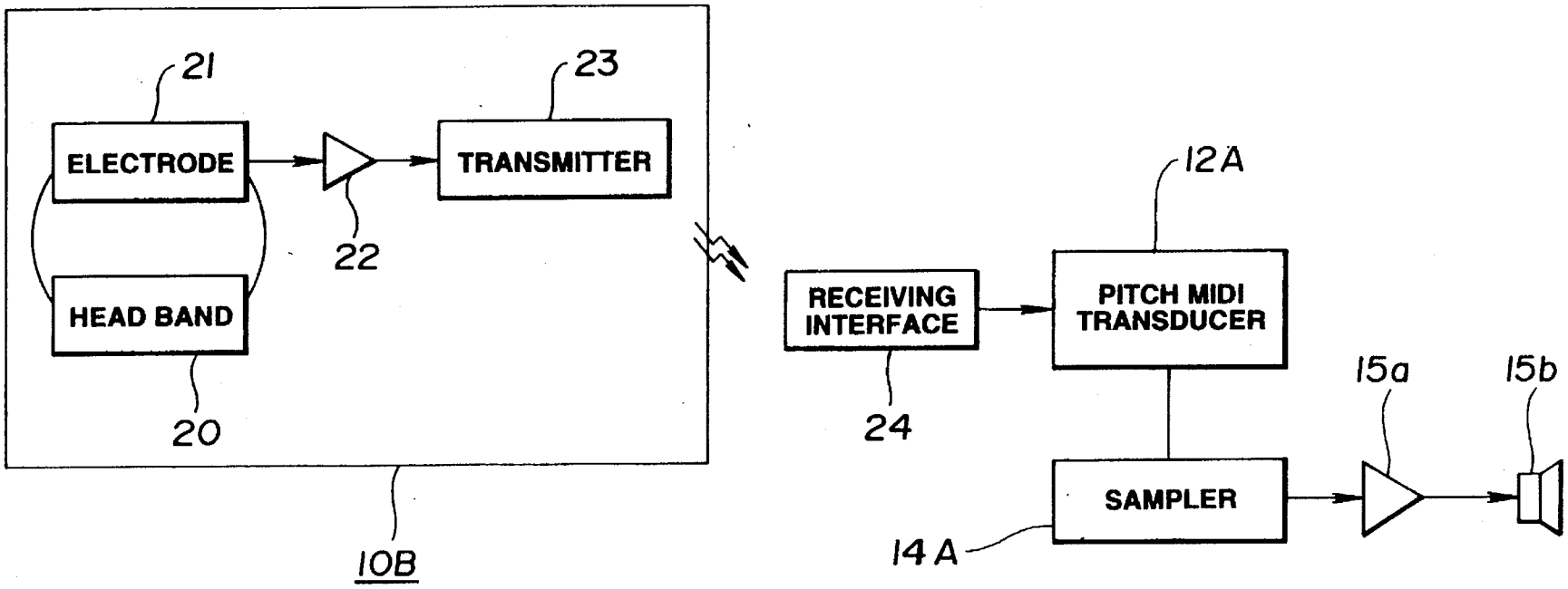
FIG. 14 is a block circuit diagram showing a sound constituting apparatus according to a second embodiment of the present invention.

Referring to FIG. 14, a sound constituting apparatus according to a second embodiment of the present invention will be explained in detail. In this figure, the parts or components which are the same as those of the previous embodiment are indicated by the same reference numerals and corresponding description is omitted for simplicity.

In the present second embodiment, a brain wave detector is employed as sensor used in the sensor section 10*a* shown in FIG. 1, in place of the microphone 10A of the first embodiment described above.

With the present brain wave detector 10B, a head band 20, an electrode 21 and a transmitter 23 are formed into one unit. The detected brain wave signals are supplied by a telemetric system to the sound constituting apparatus via a receiving interface 24 having an electric wave receiver provided in the sound constituting apparatus so as to be ultimately used as a trigger signal for sound production.

Meanwhile, the brain wave data may be translated via a MIDI interface into MIDI standard signals. The brain wave electrical signals, supplied from the receiving interface 24 are supplied to a data analysis unit 11; where the pitch and the sound volume are extracted from the waveform of the electrical signals before translation into output MIDI signals by sampler 14A. The sampler 14A transmits to the sound producing circuit section 1 sound-producing signals which are the MIDI signals adapted to phonemes and various sound elements consistent with the software operation. The sound producing circuit section 15 amplifies the signals supplied thereto by an amplifier 15*a* for producing the sound totally different from electrical signals entered at the speaker 15*b*.

The brain waves detected in this manner are classified according to the actual detection frequency. The brain waves are classified into a δ wave from a low frequency to 4 Hz, a Θ wave from 4 to 8 Hz, an a wave from 8 to 13 Hz and a β wave of 13 Hz or higher.

The brain wave reflects the function and the state of activity of the brain and the mental state of a person being tested. The α wave is generated at the occipital region while the person is at rest or closing his eyes, while β wave is generated when the person is in a tense state of mind or noncentrating his attention. The δ wave and Θ wave are the brain waves generated while the person is asleep. The above general tendency exists for the brain waves although it differs slightly from person to person. The mental state of a person being tested may be adjusted by taking advantage of this general tendency.

The sound producing apparatus may be used as an apparatus for adjusting the mental state of the person by taking advantage of this general tendency. For example, if it is desired to tranquilize the mental state of the user, it suffices to set the sound producing apparatus to generate a sound on detection of the brain waves which will instigate detection of the α wave. The user is at a position of inducing the α waves on listening to the generated sound. The sound producing apparatus may be used in this manner as a training equipment for self-control by feeding back desired brain waves by the generated sound.

The method for detecting the brain waves is not limited to the above-described method. For example, a magnetic field is generated by the nerve current flowing responsive to the brain activity. The density of the magnetic flux on the scalp may be measured for finding the nerve current flowing in the brain. This nerve current and changes in the detected magnetic field may be employed as input signals to the sound constituting apparatus. For example, the magnetic field induced by the acoustic organ is nged as a result of stimuli given to the auditory organ by a variety of sounds such as pure tone, click sound, noise, musical sound, syllable or words. The magnetic field induced by the acoustic organ is also changed as a result of stimuli given to the visual sense by a spot light, sinusoidal grating pattern, checkerboard pattern or random pattern. If these signals are used as input signals, it becomes possible for the sound constituting apparatus to produce the sound associated with the aural or visual sense.

The input information to the sensor, employed as a trigger signal, is not limited to the brain wave. For example, one of biological parameters, namely the body temperature, pulsation, perspiration, number of breaths etc. may be sensed by a sensor and supplied to the sound constituting apparatus, or the sound may be produced responsive to changes in biorhythms represented by the remaining three parameters.

Figure 15:
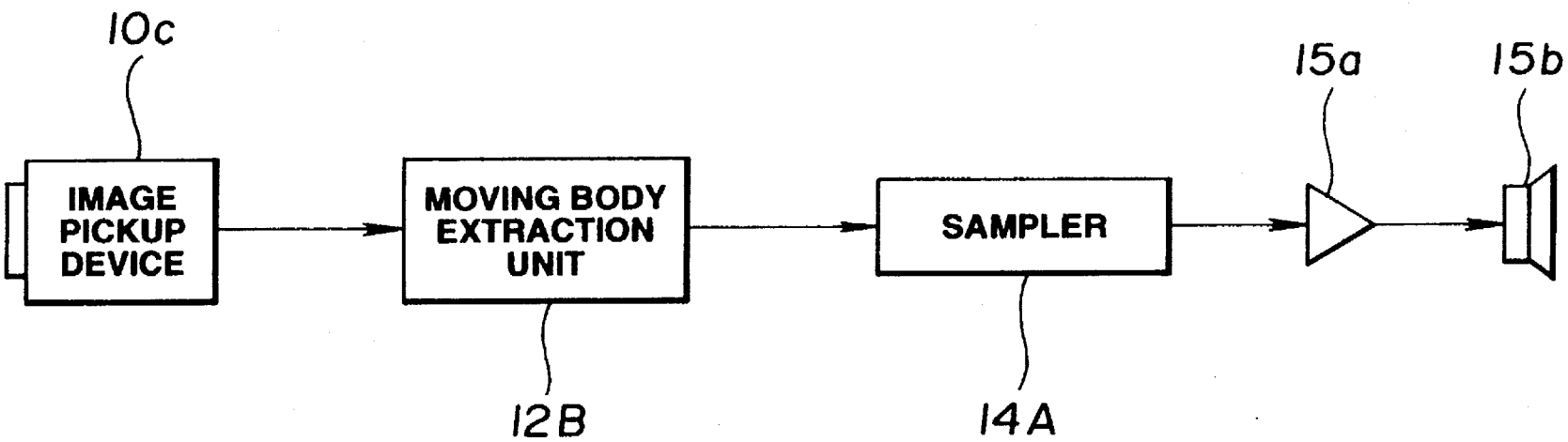
FIG. 15 is a block circuit diagram showing a sound constituting apparatus according to a third embodiment of the present invention.

Referring to FIG. 15, the sound constituting apparatus according to the third embodiment of the present invention is explained in detail. The parts or components similar to those used in the previous embodiments are indicated by the same numerals and the corresponding description is omitted for simplicity.

In the present third embodiment, an image pickup device 10C different from microphone 10A of the first embodiment is employed as a sensor employed in the sensor section 10*a* shown in FIG. 1.

The image information picked up by the image pickup device 10C is supplied to a moving body extracting unit 12B.

The moving body extracting unit 12B automatically extracts the amount of movement of the moving member from a sequence of the moving picture. The electrical signals produced on the basis of the extracted amount of movement is ultimately employed as a trigger signal in the sound constituting apparatus. The method of extracting electrical signals corresponding to the amount of movement is explained subsequently. The MIDI transducer 13 shown for example in FIG. 1 is enclosed within the moving body extracting unit 12B for translating the waveform of the extracted electrical signals into MIDI standard signals. The moving body extracting unit 12B supplies digitized MIDI signals to sampler 14A which associates the MIDI signals supplied thereto with phonemes in the same manner as in the previous embodiment and executes various effecting operations to transmit the effected signals to the sound producing circuit section 15. The sound producing circuit section 15 amplifies the sound-producing signals supplied thereto by amplifier 15*a* to produce the sound totally different from the electrical signals entered at speaker 15*b*.

With the method for extracting electrical signals corresponding to the amount of movement of the moving member in the moving member extracting section 12B, the direction of movement of the moving body is treated vectorially, while plural concerted movements of the moving body are treated as being of a robust body. The algorithm of the extracting method is such that a pedestrian, for example, as a moving body, is treated as a non-rigid body, while the motion of a real picture with respect to the noise as a non-rigid body with respect to the noise is treated as a robust body. The pedestrian and the motion are extracted from the picture picked up by the image pickup unit.

With the above algorithm, an area picture is found by a threshold processing which has subtracted the background exclusive of the moving picture from the input picture in the motion extraction.

Then, by converging by time smoothing, an averaged motion vector of the pedestrian corresponding to an individual object is found.

The area thus detected by time smoothing is further divided into sub-areas. Repeated merger is performed based on the amalgamation hypothesis of two arbitrary areas after this further division. The amalgamation hypothesis is a hypothesis which states a method of evaluation based on the adaptability degree afforded by a probabilistic model of a pedestrian picture by taking advantage of the fact that various parts of the same person are moved in a concerted manner.

By the above operation, the moving body in a moving picture, in this case the pedestrian, may be extracted by a probabilistic model. The above-described sequence of the processing operations is regarded as corresponding to the perceptual integrity of a human. Therefore, the information concerning the movement detection may be regarded as the information based on the biological activities. By supplying the information from the external environment to the sound constituting apparatus so as to be used as the trigger signal, it becomes possible for the sound producing apparatus to effect sound reproduction which is able to interact with the environment with rich fortuity and unexpectedness without temporal constraint.

Figure 16:
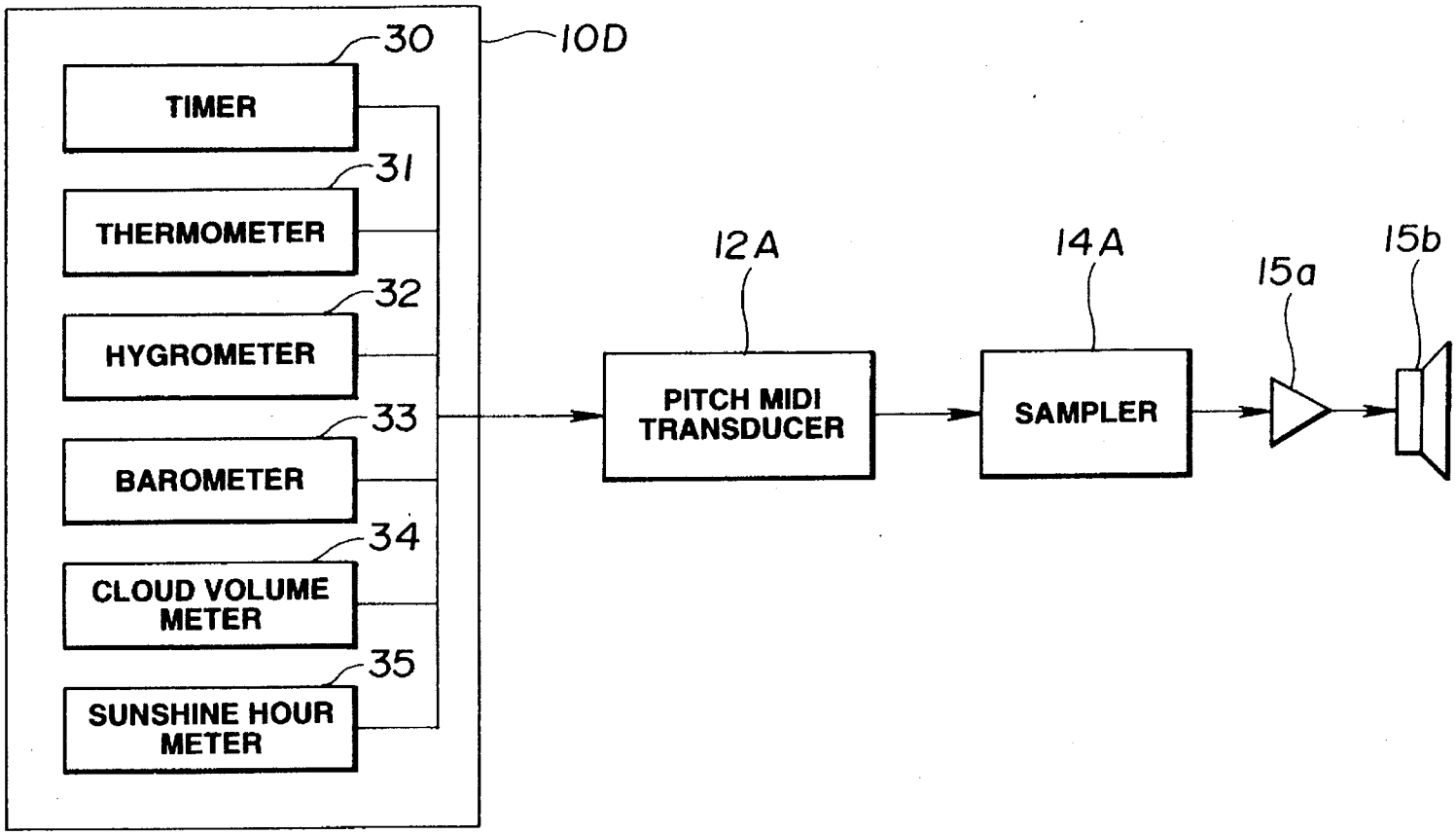
FIG. 16 is a block circuit diagram showing a sound constituting apparatus according to a fourth embodiment of the present invention.

Referring to FIG. 16, the sound constituting apparatus according to the fourth embodiment of the present invention is explained in detail. The parts or components similar to those used in the previous embodiments are indicated by the same numerals and the corresponding description is omitted for simplicity.

In the present fourth embodiment, a meteorological observation device 10D different from microphone 10A of the first embodiment is employed as a sensor employed in the sensor section 10*a* shown in FIG. 1.

The meteorological observation device 10D is able to supply the time information for recording at least the time of observation. The observation device also detects, as the information concerning meteorological elements, namely the temperature, humidity, atmospheric pressure and lightness, by means of a timer 30, thermometer 31, hygroscope 32, a barometer 33, a phonemeter 34 and a sunshine duration meter 35. The detected signals concerning these physical elements are supplied as electrical signals to e.g. the pitch-MIDI converter 12A. The pitch-MIDI converter converts various electrical signals into MIDI input signals which are supplied to sampler 14A. The sampler 14A previously supplies phonemes corresponding to the external environment conforming to MIDI signals and performs various effecting operation on selected phonemes by a software technique to transmit the resulting signals to the sound producing circuit 15.

The circuit 15 amplifies the sound-producing signals supplied thereto by amplifier 15*a* to produce the sound which is totally different from the input electrical signals.

By the above constitution, it becomes possible to control the sound production in conformity to changes in season and climate. Besides, it becomes possible to apprise the user of changes in time and season. In addition, it is possible for the sound producing apparatus to exhibit acoustic effects associated with the information concerning the tides which recently has become known to have an intimate relation with the rhythm of human activities. With the present sound producing apparatus, sound production control may be performed which takes interaction with the environment into consideration.

Meanwhile, it is only necessary for the meteorological observation device 10D, employed as the sensor in the above-described embodiment, to use selectively at least one only of the above-mentioned meteorological elements. The above-described first to fourth embodiments may be combined for further improving the interaction with the external environment.

Figure 17:
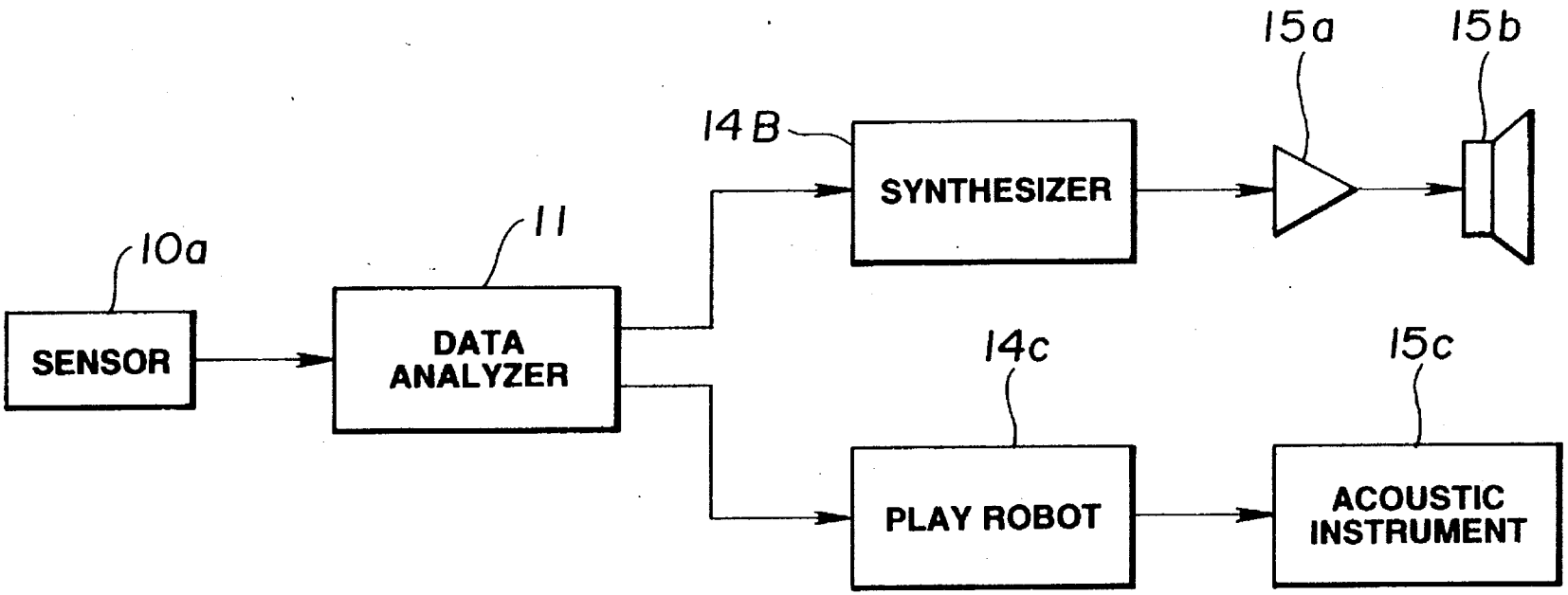
FIG. 17 is a block circuit diagram showing a sound constituting apparatus according to a fifth embodiment of the present invention.

Referring to FIG. 17, the sound constituting apparatus according to the fifth embodiment of the present invention is explained in detail. The parts or components similar to those used in the previous embodiments are indicated by the same numerals and the corresponding description is omitted for simplicity. The sensors employed in the first to fourth embodiments may also be employed singly or in combination as the sensor of the present embodiment.

The sound source generating circuit 14 shown in FIG. 1 comprises a phoneme generator 14*a* for generating sound signals consistent with the MIDI information supplied from the MIDI signal converting circuit section 13 within the data analysis section 11, and an effector 14*b* for affording acoustic effects to the sound generated responsive to the MIDI information supplied from the phoneme generator 14*a*.

Although the sound source generating circuit section 14 of each of the previous embodiments makes use of the sampler 14A, it is also possible to use the usual synthesizer 14B as a sound source. The synthesizer 14B also has the functions of completion of envelope control, mixing of different waveforms, editing of sound source waveforms, such as linking, or of simultaneous sound production of plural sound sources. It is possible in this manner to produce complex changes in tone color from a simple waveform. By such completion of the sound source, it becomes possible to improve the sound expression further to contribute to saving in storage capacity.

Besides, the use of the sampler 14A described in controlling the sound source circuit section 14 has an advantage that it may be used for longer phrases. However, if the MIDI signals of the MIDI standard supplying changes in input signals from the sensor unit 10*a*, the control information such as the song change information or the start/stop sequencer control information to the signal translating circuit section 13, it is possible for the sound source generating circuit section 14 to control the sequential data of the song change information or the control information in accordance with the sound state. By such control of the sequential data, it becomes possible to improve the sound expression to achieve saving in storage capacity.

It is noted that the variation in the sound source is not limited to the above-mentioned sampler 14A or synthesizer 14B. For example, by employing the above-mentioned control information for controlling the mechanical movement of operating a play robot 14C, it becomes possible to control an acoustic musical instrument 15*c* played by the robot 14C to produce the corresponding sound from the musical instrument 15*c*.

Finally, the sound producing apparatus of the present invention is employed as a small-sized personal equipment, as shown in FIG. 19.

Figure 18:
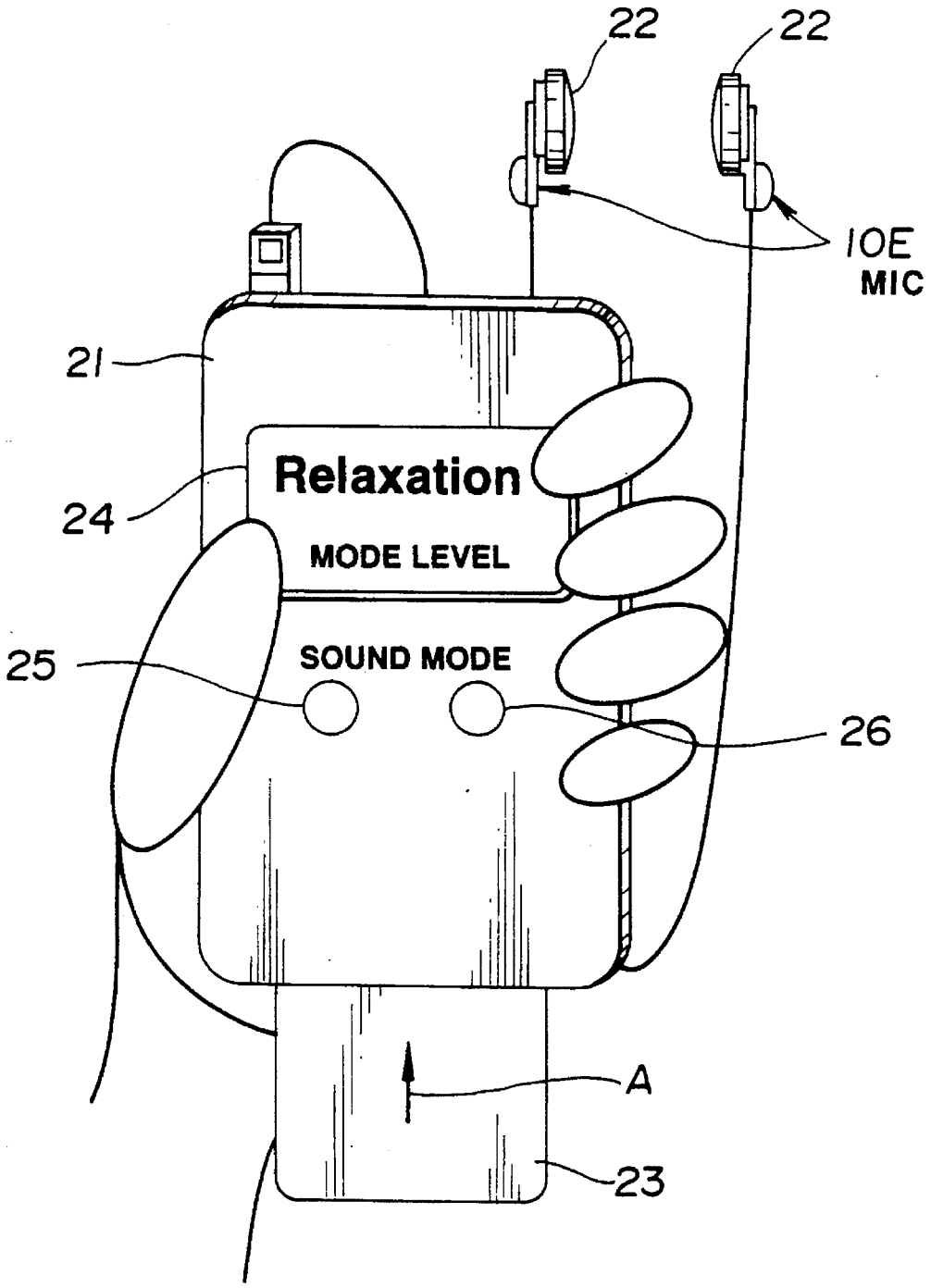
FIG. 18 is a perspective view showing a sound constituting apparatus of the present invention designed as an equipment for personal use.

A casing 21 of the sound producing apparatus is dimensioned to permit handling with one hand, as shown in FIG. 18. The environmental sound, such as the noise, which is the trigger employed in the sound producing apparatus, is entered to the main body of the apparatus via microphones 10E, 10E provided on the opposite sides to a pair of earphones 22, 22.

A card 23, made up of a memory or an IC having the digital information therein, is introduced at a lower section of the apparatus. The digital information stored in card 23 carries the phonemes and the software data of how to process the phonemes. The sound producing apparatus displays on a display window 24 what sound is produced on inserting the card 23 in the direction of arrow A when the power source is turned on.

The information displayed on the display window 24 is the sound mode exemplified by "relaxation", "nature" and "music" which is selected by a sound mode selection switch 25. The "relaxation" mode is a mode which generates relaxed sound which produces mental stability. The "nature" mode is a mode which is capable of supplying the sound conforming to the natural sites such as seaside, mountain or river. The site selection is by a selection switch 26. For the "music" mode, the sound producing apparatus selects one of the modes of producing the music such a "Jazz", "rock", "soul", "classic", "Latin", "leguee", "blues", "country" and "India", using selection switch 26. The sound conforming to the selected mode is produced via earphones 22, 22 responsive to the trigger. It is also possible to display the sound volume level in the display window 24.

This sound production is not limited to the above-mentioned modes and the music other than the above modes may be supplied by exchanging the card 23 introduced into the apparatus.

By employing the card in this manner, it becomes possible to increase the latitude in sound creation. The sound producing apparatus may be supplied as a stereo cassette for continuously supplying the music of various modes, while it may also be supplied as toys for children.

In distinction from the conventional digital signal processor for waveform conversion of the original sound, the sound producing apparatus of the present invention renders it possible to produce the sound which is completely different from the original sound. The sound producing elements or phonemes as the trigger may be edited easily without the necessity of employing non-linear control employing the chaos thesis which is the non-linear theory or fuzzy theory employing the fuzzy theory at a higher level required in the transformation of the original sound into the sound totally different from it. Above all, with the present sound producing apparatus, the noise of the environment may be instantly changed into conformity to the surrounding conditions.

Besides, the sound producing apparatus renders it possible to reproduce the sound rich in fortuity, unexpectedness or interactivity by interaction with the listener or with the listening environment.

In distinction from the acoustic apparatus for reproducing the recording medium, the sound producing apparatus renders it possible to eliminate time dependency such as dependency on the possible play time. The data required by the sound producing apparatus for the constitution of the sound or music are time-independent and may be reduced to a minimum.

It is possible with the sound producing apparatus to formulate the music or the imaginary actual sound consistent with the pre-stored program without employing complicated digital equipment.

As for the program software employed in the sound producing apparatus, it is possible to offer to the market a new time-independent music software, on the basis of limited data as mentioned above.

Meanwhile, there is no particular limitation to the sensor and the sound conforming to input signals may be produced with the use of a sensor capable of achieving interactivity with the external environment. If an integrated circuit available on the market is used, the sound constituting apparatus may be realized by a simplified construction without the use of an enlarged system as in the previously described embodiments.

What is claimed is:

1. A sound constituting apparatus in which information of phoneme elements constituting a first sound is previously stored in a storage element and is interacted with a state of an external environment or changes of said state to produce a modified sound on a real-time basis without constraint as to a play time interval, comprising:

input detection means for detecting the state of the external environment or change of said state and producing output electrical signals;

data extraction means for extracting results of analyses of the electrical signals obtained from said input detection means as data;

sound source controlling means for outputting sound source control data based on the data extracted by said data extraction means;

sound source means for outputting output sound signals by modifying the information of phoneme elements in response to said sound source control data; and sound producing means for converting output sound signals of said sound source means into the modified sound.

2. The sound constituting apparatus of claim 1 wherein said external environment includes at least one of a second sound, vibrations, light, temperature, humidity, and atmospheric pressure, as physical parameters, and time, day, and season, as time parameters, and brain waves, body temperature, pulsation, perspiration and the number of breaths, as biological information parameters and detects the state and changes in state in said external environment or living body to translate the state or changes thereof into electrical signals.

3. The sound constituting apparatus of claim 1 wherein said input detection means comprises acousto-electrical converting means for detecting a noise in the external environment for translation into said electrical signals.

4. The sound constituting apparatus of claim 3 wherein said data extraction means extracts as data a sound pitch from the electrical signals converted from the noise of the external environment by said acousto-electric converting means.

5. The sound constituting apparatus of claim 3 wherein said data extraction means extracts as data sound volume information as level values from the electrical signals converted by said acousto-electrical converting means.

6. The sound constituting apparatus of claim 1 wherein said input detection means comprises an image pickup device.

7. The sound constituting apparatus of claim 6 wherein said data extraction means extracts a volume change in a picked up picture as the data.

8. The sound constituting apparatus of claim 1 wherein said sound source controlling means converts data from said data extraction means into MIDI information.

9. The sound constituting apparatus of claim 1 wherein said sound source means outputs phoneme signals responsive to pitch data of the MIDI information from said sound source controlling means in the form of signals adapted to sound volume data of said MIDI information.

10. The sound constituting apparatus of claim 1 wherein said sound source controlling means converts data from said data extraction means into control data conforming to volume data of the MIDI information.

11. The sound constituting apparatus of claim 10 wherein said sound source means comprises sound source signal generating means for generating output sound signals responsive to the MIDI information supplied from said sound source controlling means, and acoustic effect generating means for supplying acoustic effects to the output sound signals generated responsive to the MIDI information supplied by said sound source controlling means.

* * * * *